US008449086B2

(12) United States Patent
Price et al.

(10) Patent No.: US 8,449,086 B2
(45) Date of Patent: May 28, 2013

(54) INKJET CHAMBER AND INLETS FOR CIRCULATING FLOW

(75) Inventors: Brian G. Price, Pittsford, NY (US); Christopher N. Delametter, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 50 days.

(21) Appl. No.: 13/075,297

(22) Filed: Mar. 30, 2011

(65) Prior Publication Data

US 2012/0249686 A1 Oct. 4, 2012

(51) Int. Cl.
*B41J 2/02* (2006.01)

(52) U.S. Cl.
USPC ..... 347/75

(58) Field of Classification Search
None
See application file for complete search history.

(56) References Cited

U.S. PATENT DOCUMENTS

| | | | | |
|---|---|---|---|---|
| 4,502,060 | A * | 2/1985 | Rankin et al. | 347/65 |
| 5,455,613 | A * | 10/1995 | Canfield et al. | 347/65 |
| 5,666,143 | A * | 9/1997 | Burke et al. | 347/65 |
| 5,912,685 | A * | 6/1999 | Raman | 347/65 |
| 6,652,079 | B2 * | 11/2003 | Tsuchii et al. | 347/65 |
| 7,857,422 | B2 | 12/2010 | Delametter et al. | |
| 2004/0263578 | A1 | 12/2004 | Lee et al. | |
| 2008/0198208 | A1 * | 8/2008 | Kyoso et al. | 347/85 |

FOREIGN PATENT DOCUMENTS

| | | |
|---|---|---|
| EP | 0124311 | 11/1984 |
| EP | 0894626 | 2/1999 |
| EP | 1186414 | 3/2002 |
| JP | 8067006 | 3/1996 |
| JP | 2007-069126 | 3/2007 |

* cited by examiner

*Primary Examiner* — Matthew Luu
*Assistant Examiner* — Michael Konczal
(74) *Attorney, Agent, or Firm* — Peyton C. Watkins

(57) ABSTRACT

An inkjet printhead including a drop generator includes: a substrate including a surface; a chamber disposed on the surface of the substrate, the chamber including: an inlet having a first edge and a second edge, the second edge being separated from the first edge by an inlet width along an inlet width direction; and a chamber center, wherein the first edge and the second edge of the inlet are disposed on a same side of the chamber center relative to the inlet width direction.

11 Claims, 13 Drawing Sheets

INKJET CHAMBER AND INLETS FOR CIRCULATING FLOW

CROSS REFERENCE TO RELATED APPLICATION

Reference is made to commonly assigned, concurrently filed and co-pending U.S. patent application Ser. No. 13/075,312, filed herewith, entitled: "Inkjet Chamber Refill Method with Circulating Flow," the disclosure of which is incorporated herein.

FIELD OF THE INVENTION

The present invention relates generally to an inkjet drop generator, and more particularly to a design of the drop generator chamber and inlets that facilitates a circulating flow of ink as ink fills the chamber.

BACKGROUND OF THE INVENTION

Inkjet printing is typically done by either drop-on-demand or continuous ink jet printing. In drop-on-demand inkjet printing ink drops are ejected onto a recording surface using a pressurization actuator (thermal or piezoelectric, for example). Selective activation of the actuator causes the formation and ejection of a flying ink drop that crosses the space between the printhead and the print media and strikes the print media. The formation of printed images is achieved by controlling the individual formation of ink drops, as is required to create the desired image. For continuous inkjet a pressurized ink source produces a continuous stream of ink drops and a deflection mechanism (electrostatic or air flow, for example) separates drops intended for printing from drops not intended for printing. The drops not intended for printing are caught in a gutter and either recycled or disposed.

Motion of the print medium relative to the printhead can consist of keeping the printhead stationary and advancing the print medium past the printhead while the drops are ejected. This architecture is appropriate if the nozzle array on the printhead can address the entire region of interest across the width of the print medium. Such printheads are sometimes called pagewidth printheads. A second type of printer architecture is the carriage printer, where the printhead nozzle array is somewhat smaller than the extent of the region of interest for printing on the print medium and the printhead is mounted on a carriage. In a carriage printer, the print medium is advanced a given distance along a print medium advance direction and then stopped. While the print medium is stopped, the printhead carriage is moved in a carriage scan direction that is substantially perpendicular to the print medium advance direction as the drops are ejected from the nozzles. After the carriage has printed a swath of the image while traversing the print medium, the print medium is advanced; the carriage direction of motion is reversed; and the image is formed swath by swath.

A drop generator in an inkjet printhead includes a chamber having an ink inlet for providing ink to the chamber, and a nozzle for jetting drops out of the chamber. Two side-by-side drop generators are shown in prior art FIG. 1 (as in US Patent Application Publication No. 2004/0263578) as an example of a conventional thermal inkjet drop on demand drop generator configuration. Partition walls 20 are formed on a base plate 10 and define chambers 22. A nozzle plate 30 is formed on the partition walls 20 and includes nozzles 32, each nozzle 32 being disposed over a corresponding chamber 22. Ink enters chambers 22 by first going through an opening in base plate 10, or around an edge of base plate 10, and then through ink paths 24, as indicated by the arrows in FIG. 1.

FIG. 2 is a schematic top view of the configuration of the prior art drop generator type shown in FIG. 1, but with additional labeling details not provided in US Patent Application Publication No. 2004/0263578. Chamber 22 includes an inlet 27 having a first edge 27*a* and a second edge 27*b*. Inlet 27 includes a width W between first edge 27*a* and second edge 27*b*. Chamber 22 includes a center 21 (indicated by the cross hairs). In this example, the nozzle 32 and the heater 13 have centers that are in line with the chamber center 21, but that is not always the case. First edge 27*a* and second edge 27*b* of inlet 27 are substantially symmetrically arranged relative to chamber center 21, i.e. they are disposed on opposite sides of the chamber center, relative to the inlet width direction. Ink path 24 (called a channel herein) includes an entry region 25, a neck region 26, and then a gradually wider region that connects to inlet 27 of chamber 22. Ink enters the chamber 22 from ink feed 35, an opening in the base plate 10 (called a substrate herein) through channel 24. When heater 13 is briefly pulsed, it vaporizes a portion of the ink, and the growing vapor bubble pushes a drop of ink out of nozzle 32. Some of the force of the growing bubble pushes ink backward through channel 24, but the chamber walls 29 and the increased fluid impedance due to neck region 26 are designed to direct a large portion of the force of the growing vapor bubble to eject the drop of ink. The vapor bubble is either vented through the nozzle 32, or it collapses in chamber 22. Capillary action and reduced pressure in the chamber draw ink in to refill chamber 22. The fluid impedance of channel 24 is designed to allow rapid refill for ejection of the next drop, as well as to direct vapor bubble forces toward drop ejection.

A drawback of prior art chamber configurations, including the configurations of FIGS. 1 and 2, is that some regions of the chamber, such as corners 28, can have relatively low fluid velocity during both drop ejection and ink refill. Air bubbles and particulates can accumulate in such low flow regions. Air can enter the chamber 22 through nozzle 32 or air can come out of solution from being dissolved in the ink. Unlike ink vapor bubbles which can condense completely, air bubbles are persistent unless they are removed from the chamber. Although very small air bubbles may not be a problem, as the air bubbles accumulate and grow, they can interfere with proper jetting. Similarly, small particulates that enter the chamber through channel 24 may not be a problem, but as they accumulate, they can also cause problems with proper jetting.

What is needed is a drop generator configuration and method of operation that does not allow air bubbles and particulates to accumulate in the chamber.

SUMMARY OF THE INVENTION

An inkjet printhead including a drop generator comprising a substrate including a surface; a chamber disposed on the surface of the substrate, the chamber including: an inlet having a first edge and a second edge, the second edge being separated from the first edge by an inlet width along an inlet width direction; and a chamber center, wherein the first edge and the second edge of the inlet are disposed on a same side of the chamber center relative to the inlet width direction.

DETAILED DESCRIPTION OF THE INVENTION

Figure 3:
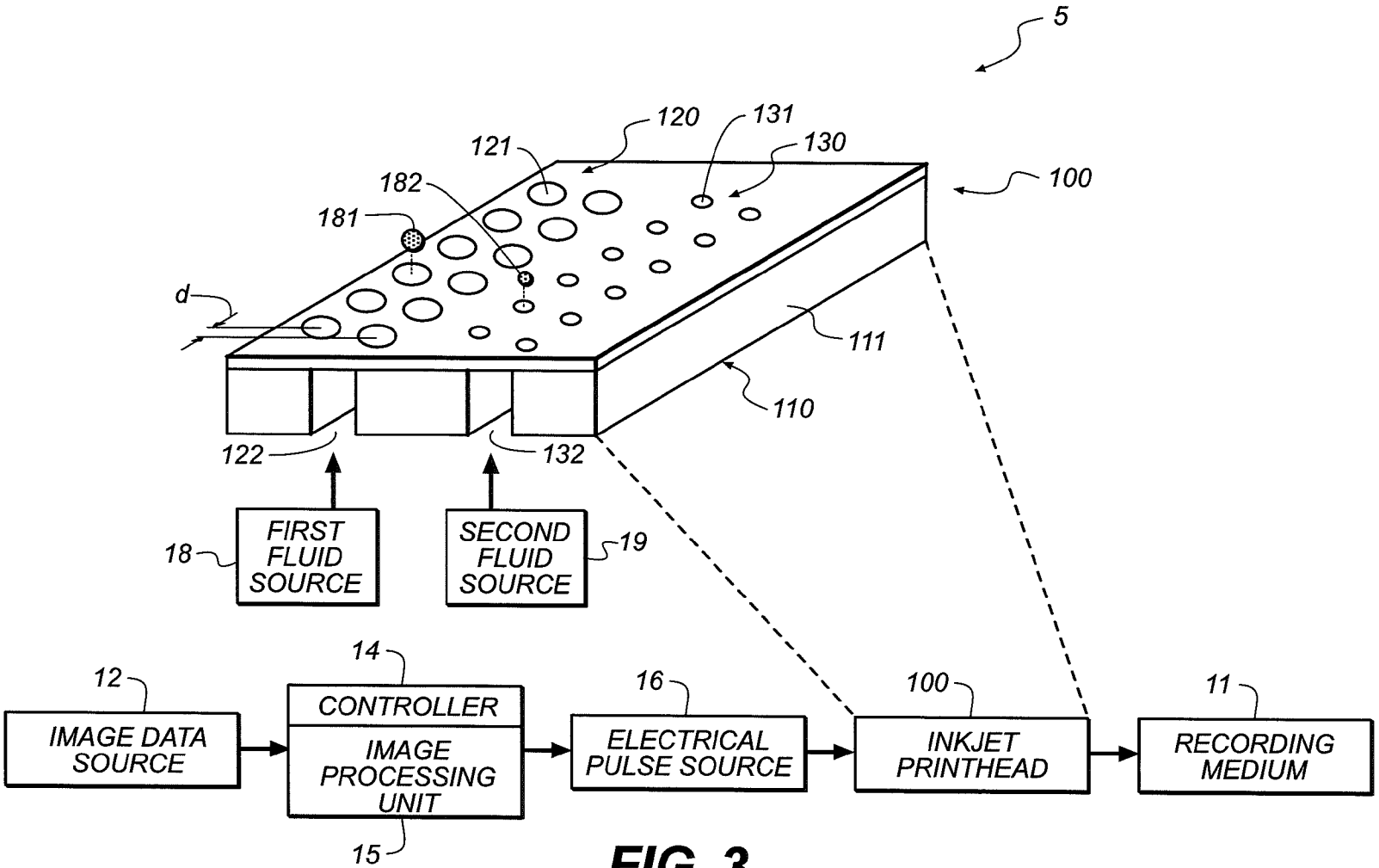
FIG. 3 is a schematic representation of an inkjet printer system.

Referring to FIG. 3, a schematic representation of an inkjet printer system 5 is shown, for its usefulness with the present invention and is fully described in U.S. Pat. No. 7,350,902, which is incorporated by reference herein in its entirety. Inkjet printer system 5 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

Figure 1:
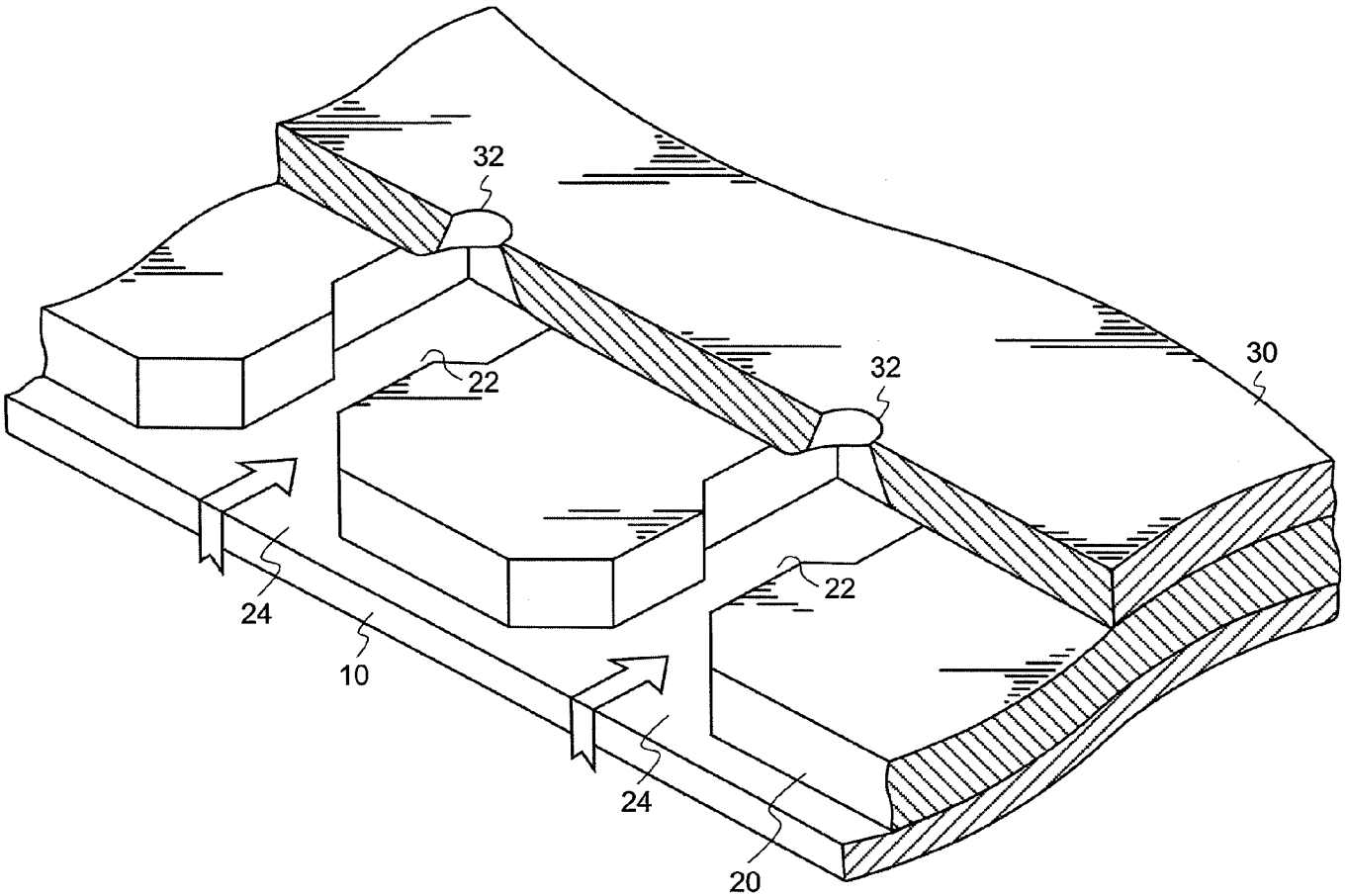
FIG. 1 (PRIOR ART)
FIG. 1 is a perspective cutaway view of a prior art drop generator configuration for a thermal inkjet drop-on-demand printhead.

In the example shown in FIG. 3, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density in each array is 1200 per inch (i.e. d=1/1200 inch in FIG. 1). If pixels on the recording medium 11 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 3 as openings through printhead die substrate 111. One or more inkjet printhead die 110 will be included in inkjet printhead 100, but for greater clarity only one inkjet printhead die 110 is shown in FIG. 3. The printhead die are arranged on a support member as discussed below relative to FIG. 4. In FIG. 3, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

Figure 2:
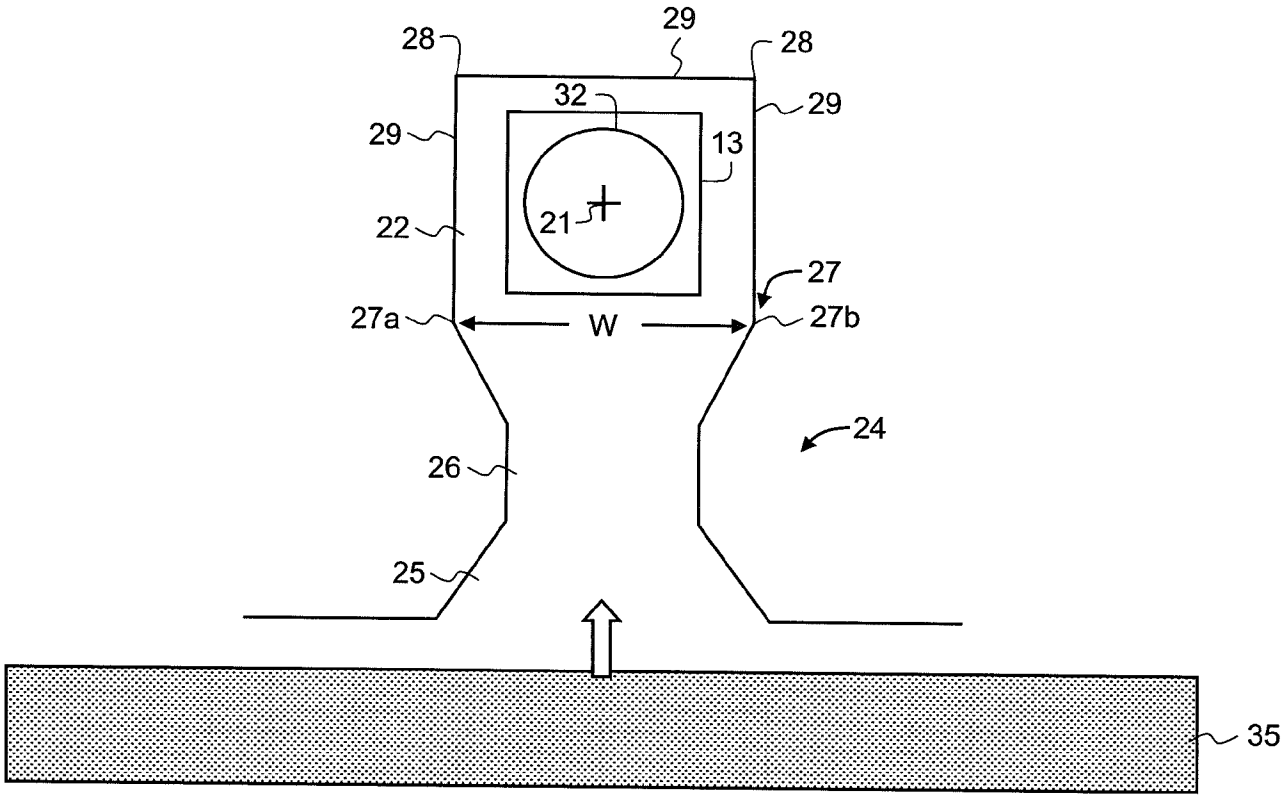
FIG. 2 (PRIOR ART)
FIG. 2 is a schematic top view of the drop generator configuration of FIG. 1.

In a drop-on-demand printhead, a drop ejector or drop generator includes a drop forming element as well as the nozzle. Not shown in FIG. 3, are the drop forming elements associated with the nozzles. Drop forming elements can be of a variety of types, some of which include a heating element to vaporize a portion of ink within a chamber and thereby cause ejection of a droplet (as described in the background relative to FIG. 2), or a piezoelectric transducer to constrict the volume of a chamber and thereby cause ejection, or an actuator which is made to move within a chamber (for example, by heating a bi-layer element) and thereby cause ejection. In any case, electrical pulses from electrical pulse source 16 are sent to the various drop ejectors according to the desired deposition pattern. In the example of FIG. 3, droplets 181 ejected from the first nozzle array 120 are larger than droplets 182 ejected from the second nozzle array 130, due to the larger nozzle opening area. Typically other aspects of the drop forming elements (not shown) associated respectively with nozzle arrays 120 and 130 are also sized differently in order to optimize the drop ejection process for the different sized drops. During operation, droplets of ink are deposited on a recording medium 11.

Figure 4:
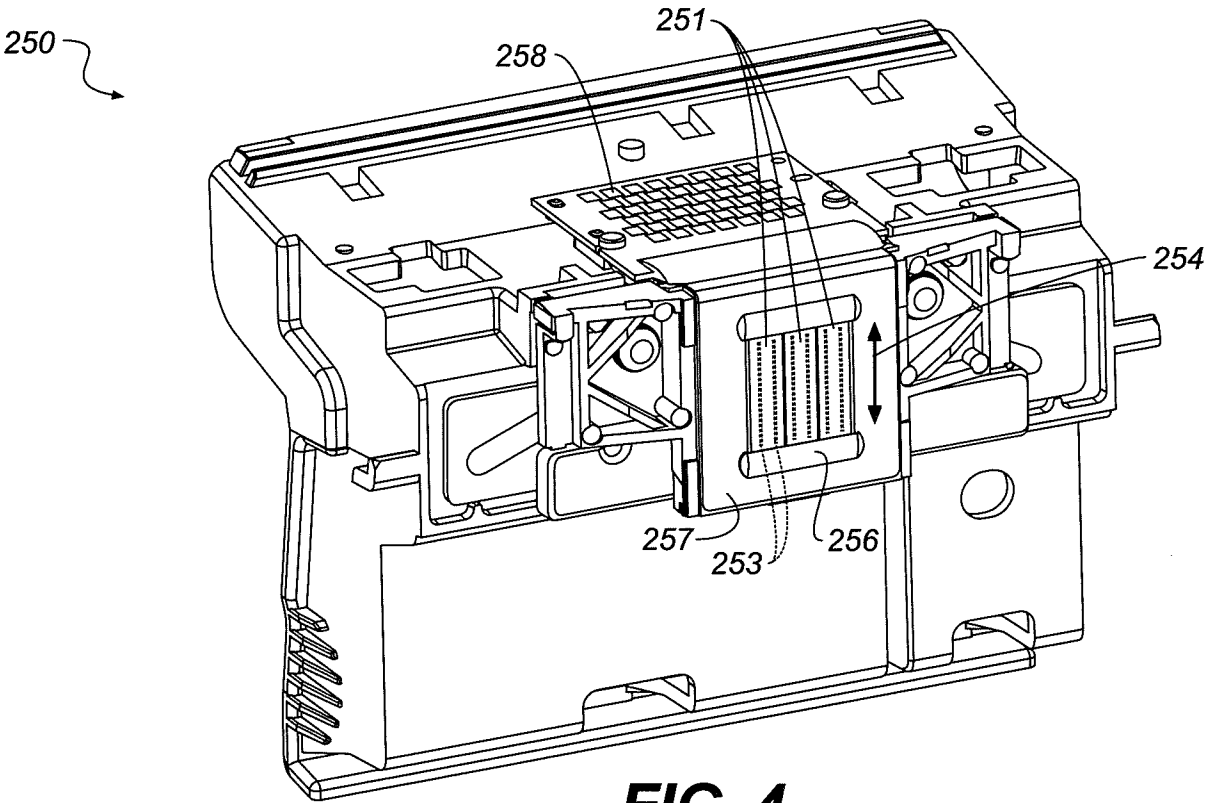
FIG. 4 is a perspective view of a portion of a printhead.

FIG. 4 shows a perspective view of a portion of a printhead 250, which is an example of an inkjet printhead 100. Printhead 250 includes three printhead die 251 (similar to printhead die 110 in FIG. 3), each printhead die 251 containing two nozzle arrays 253, so that printhead 250 contains six nozzle arrays 253 altogether. The six nozzle arrays 253 in this example can each be connected to separate ink sources (not shown in FIG. 4); such as cyan, magenta, yellow, text black, photo black, and a colorless protective printing fluid. Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead 250 across the recording medium 11. Following the printing of a swath, the recording medium 11 is advanced along a media advance direction that is substantially parallel to nozzle array direction 254.

Also shown in FIG. 4 is a flex circuit 257 to which the printhead die 251 are electrically interconnected, for example, by wire bonding or TAB bonding. The interconnections are covered by an encapsulant 256 to protect them. Flex circuit 257 bends around the side of printhead 250 and connects to connector board 258. When printhead 250 is mounted into the carriage 200 (see FIG. 5), connector board 258 is electrically connected to a connector (not shown) on the carriage 200, so that electrical signals can be transmitted to the printhead die 251.

Figure 5:
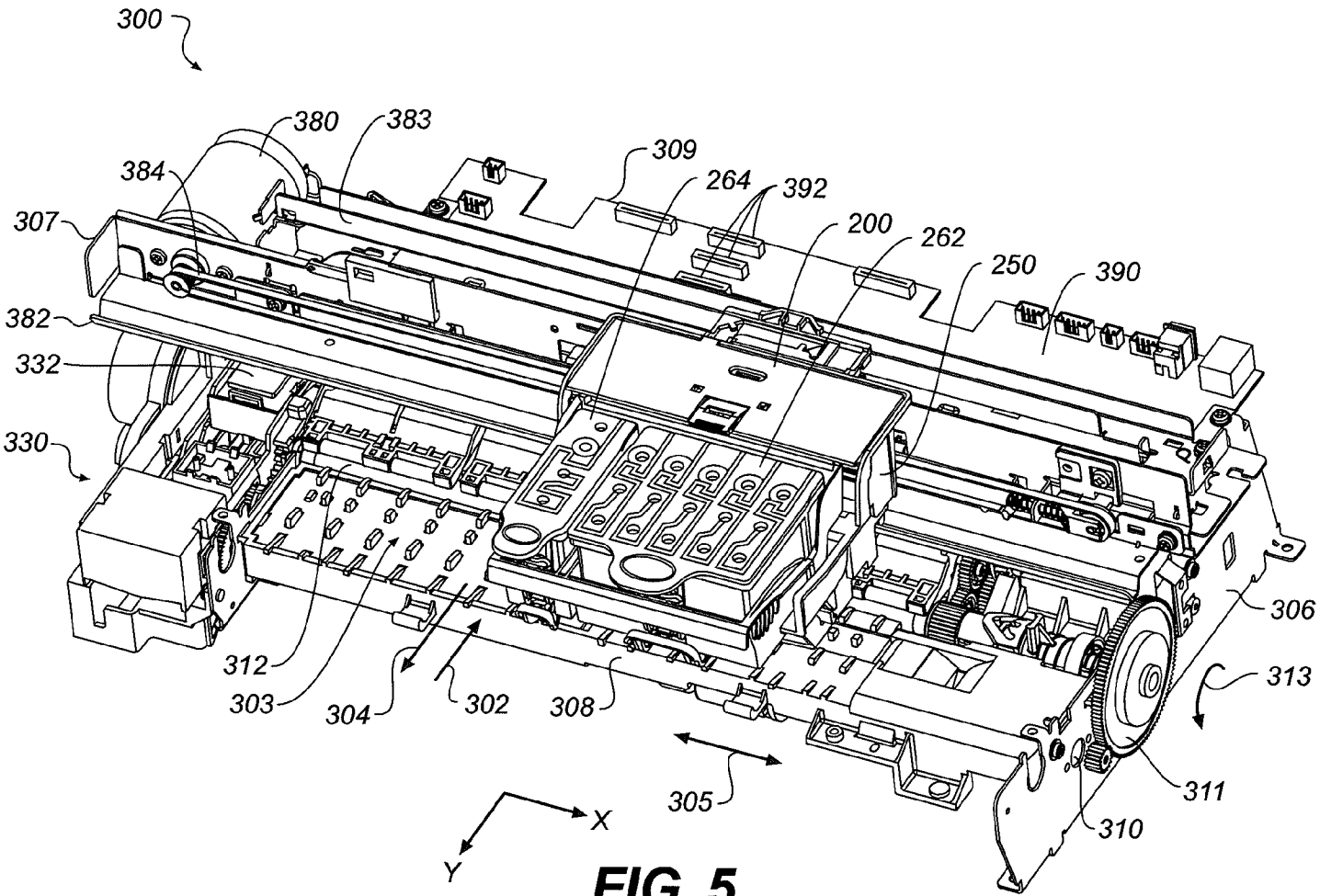
FIG. 5 is a perspective view of a portion of a carriage printer.

FIG. 5 shows a portion of a desktop carriage printer. Some of the parts of the printer have been hidden in the view shown in FIG. 5 so that other parts can be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 (not shown in FIG. 5) on printhead 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead 250 is mounted in carriage 200, and multi-chamber ink supply 262 and single-chamber ink supply 264 are mounted in the printhead 250. The mounting orientation of printhead 250 is rotated relative to the view in FIG. 4, so that the printhead die 251 are located at the bottom side of printhead 250, the droplets of ink being ejected downward onto the recording medium in print region 303 in the view of FIG. 5. Multi-chamber ink supply 262, in this example, contains five ink sources: cyan, magenta, yellow, photo black, and colorless protective fluid; while single-chamber ink supply 264 contains the ink source for text black. Paper or other recording medium (sometimes generically referred to as paper or media herein) is loaded along paper load entry direction 302 toward the front of printer chassis 308.

Figure 6:
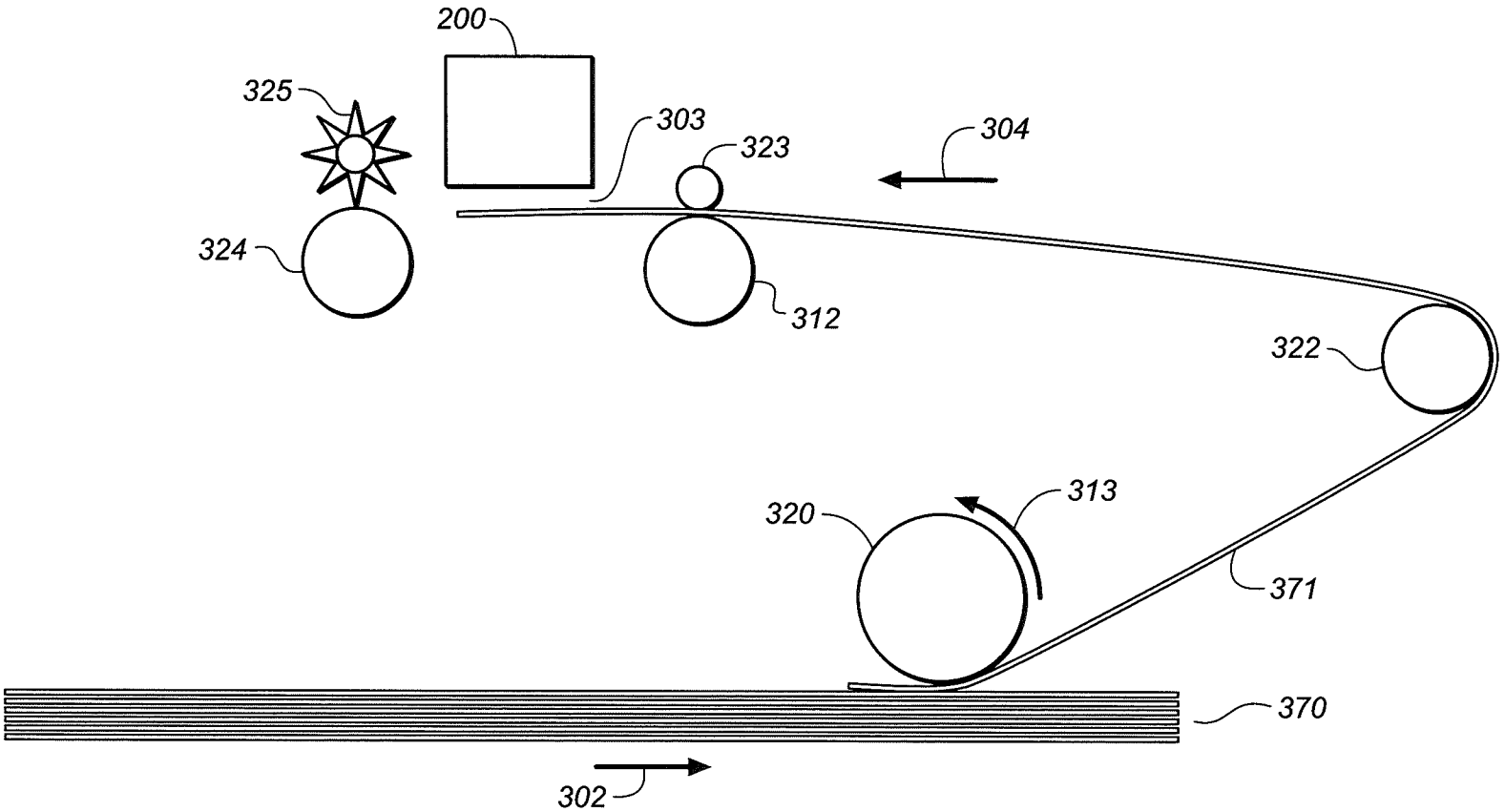
FIG. 6 is a schematic side view of an exemplary paper path in a carriage printer.

A variety of rollers are used to advance the medium through the printer as shown schematically in the side view of FIG. 6. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 5). The paper is then moved by feed roller 312 and idler roller(s) 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 5, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 5, is the maintenance station 330 including a cap 332.

Toward the rear of the printer chassis 309, in this example, is located the electronics board 390, which includes cable connectors 392 for communicating via cables (not shown) to the printhead carriage 200 and from there to the printhead 250. Also on the electronics board are typically mounted motor controllers for the carriage motor 380 and for the paper advance motor, a processor and/or other control electronics (shown schematically as controller 14 and image processing unit 15 in FIG. 3) for controlling the printing process, and an optional connector for a cable to a host computer.

Embodiments of the present invention include a drop generator chamber and inlet configuration that promote a circulating flow of ink tending to dislodge air bubbles or particulates that could otherwise accumulate near chamber walls. The circulating flow also positions the air bubbles and particulates in a region of the chamber where they may be readily ejected through the nozzle before growing to a size that could cause jetting problems.

Figure 7:
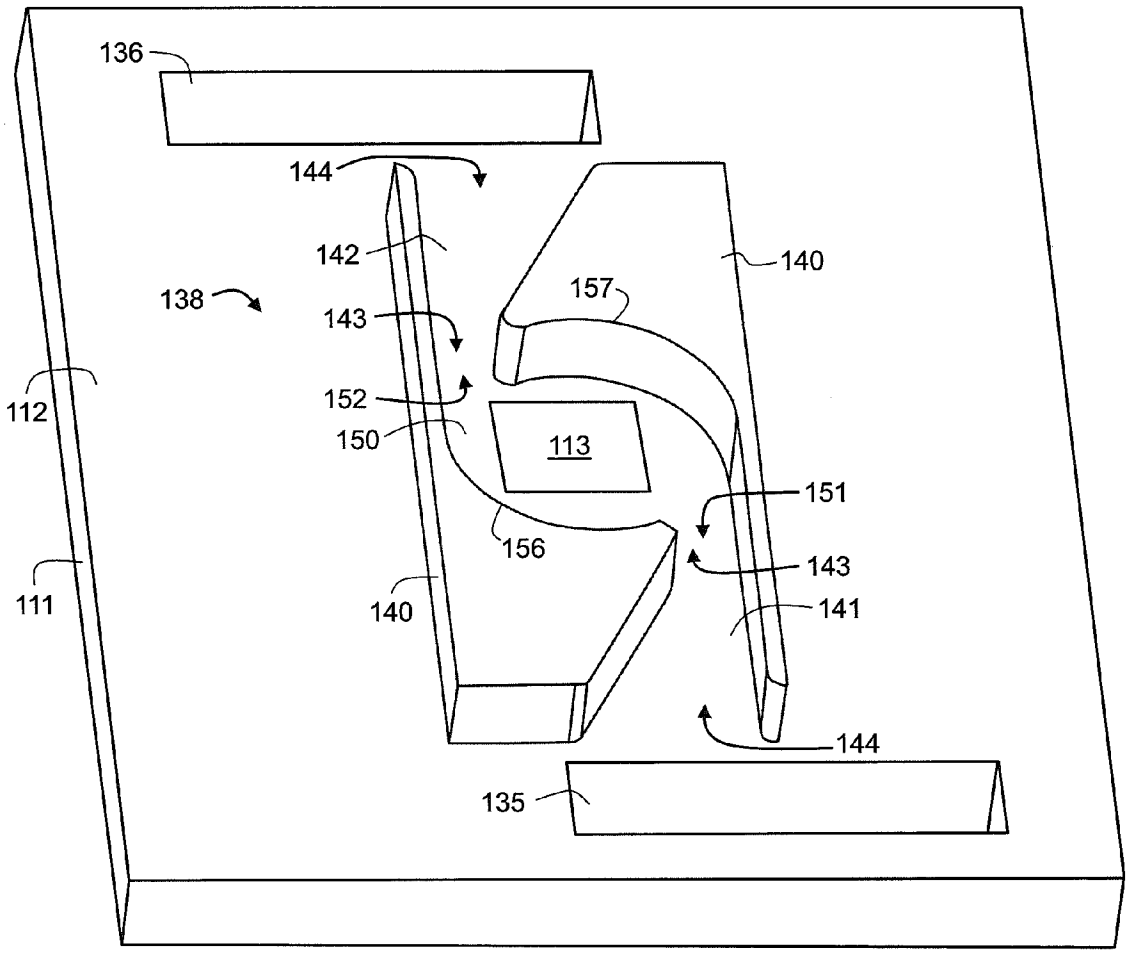
FIG. 7 is a perspective view of a drop generator having a chamber with curved walls for providing circulating flow during refill according to an embodiment of the invention.
Figure 8:
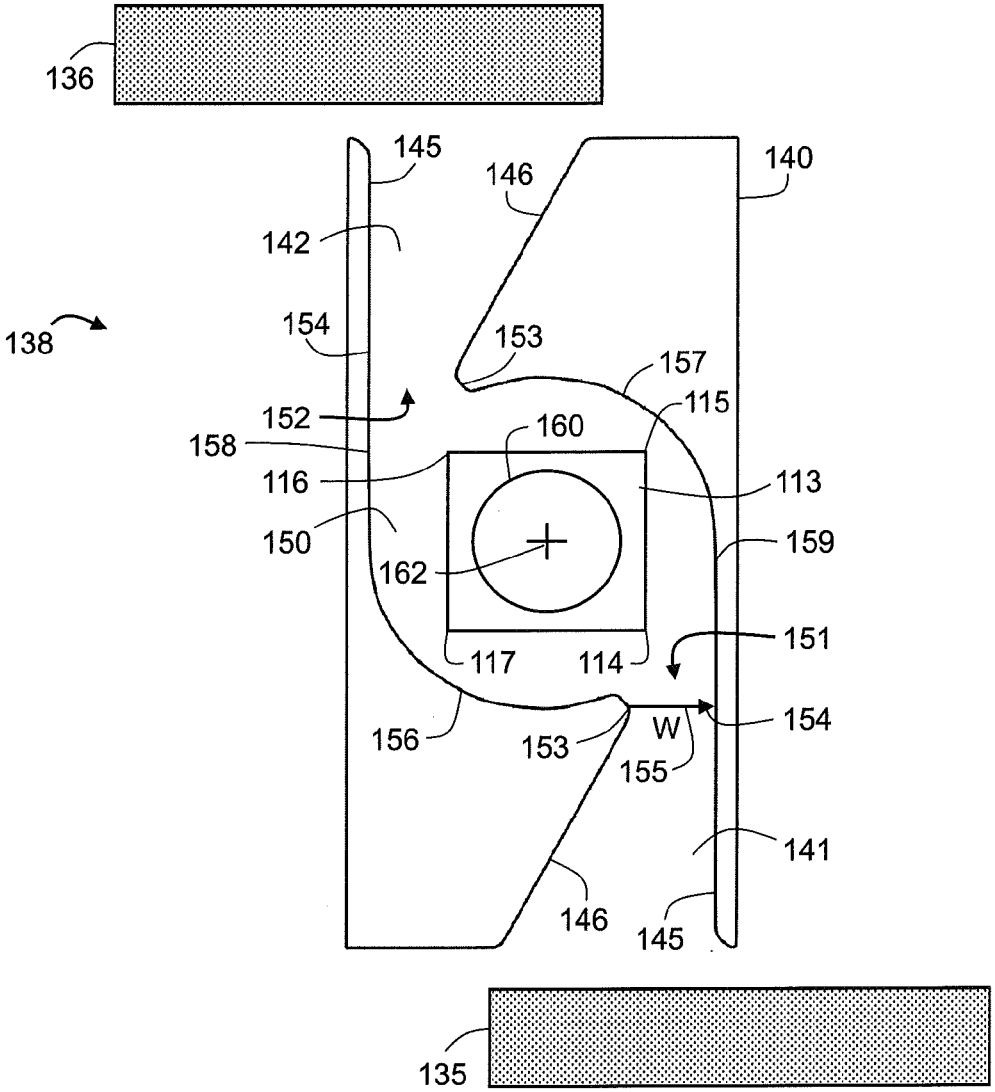
FIG. 8 is a top view of the drop generator of FIG. 7.

A preferred embodiment of a drop generator 138 for a thermal inkjet printhead is shown in the perspective view of FIG. 7 and the top view of FIG. 8. A substrate 111 made of silicon, for example, is provided with ink feeds 135 and 136 that pass through substrate 111. Partitioning walls 140 are formed on a surface 112 of substrate 111 using a material such as a polymer or a silicon oxide, for example. The partitioning walls 140 are patterned to define a chamber 150, a first channel 141 and a second channel 142 disposed on surface 112. Chamber 150 includes a first inlet 151, a second inlet 152 a first curved wall 156, a second curved wall 157, a first straight wall 158 and a second straight wall 159. First channel 141 includes a first end 143 that is adjacent first inlet 151 and a second end, opposite first end 143, that is adjacent ink feed 135. Similarly, second channel 142 includes a first end 143 that is adjacent second inlet 152 and a second end 144, opposite first end 143, that is adjacent ink feed 136. Channels 141 and 142 each include a first wall 145 and a second wall 146. First wall 145 of channel 141 extends substantially in line with second straight wall 159 of chamber 150. Similarly, first wall 145 of channel 142 extends substantially in line with first straight wall 158 of chamber 150. As shown, for each of the first and second channels 141 and 142, second wall 146 is not parallel to first wall 145, but rather gets closer to first wall 145 as the chamber 150 is approached. As a result, a width of second end 144 is greater than a width of first end 143. Walls 145 and 146 of channels 141 and 142 that converge toward chamber inlets 151 and 152 respectively provide a source of fluid impedance for proper jetting and refill, but they also help to provide a circulating flow of ink around the periphery of the chamber during ink refill as is discussed in more detail below. In addition, the converging walls facilitate the refill of chamber 150 by capillary action.

The nozzle layer is not shown in FIG. 7 in order to show other details in the drop generator 138 more clearly. Nozzle 160 (FIG. 8) is provided in the nozzle layer and is disposed opposite the surface 112 of substrate 111. Heater 113 is disposed on surface 112 of substrate 111 and at least a portion of heater 113 is typically located directly below nozzle 160.

First inlet 151 and second inlet 152 of chamber 150 each include a first edge 153 and a second edge 154 that is separated from the first edge 153 by an inlet width W along an inlet width direction 155 (FIG. 8). Chamber 150 includes a center 162 (indicated by the cross-hair). In the example shown in FIG. 8, the centers of the heater 113 and the nozzle 160 are in line with the center 162 of chamber 150, but in other configurations that need not be the case. To help provide a circulating flow within the chamber 150 during ink refill, first edge 153 and second edge 154 of first inlet 151 are located on a same side of the center 162 of chamber 150, relative to inlet width direction 155. (This is to be contrasted with the prior art configuration of FIG. 2, where the first edge 27*a* and the second edge 27*b* of inlet 27 are on opposite sides of center 21 of chamber 22.) Furthermore, first edge 153 and second edge 154 of second inlet 152 are located on a same side of center 162 as each other, but are located on an opposite side of center 162 from the side that first edge 153 and second edge 154 of first inlet 151 are located. In other words, first channel 141 includes an axis located near a first side of chamber 150, and second channel 142 includes an axis located near a second side of the chamber 150 opposite the first side.

Chamber 150 includes a first curved wall 156 and a second curved wall 157 opposite first curved wall 156. First inlet 151 is disposed between first curved wall 156 and second curved wall 157. Second inlet 152 is also disposed between first curved wall 156 and second curved wall 157, but on an opposite side of chamber 150. Heater 113 includes a rectangular outline having a first corner 114, a second corner 115, a third corner 116 diagonally opposite first corner 114, and a fourth corner diagonally opposite second corner 115. First corner 114 is located adjacent first inlet 151 and third corner 116 is located adjacent second inlet 152. Second corner 115 is located adjacent second curved wall 157 and fourth corner 117 is located adjacent first curved wall 156. Drop generator 138 also includes a first straight wall 158 that extends tangentially from first curved wall 156 of chamber 150 to second channel 142, and a second straight wall 159 that extends tangentially from second curved wall 157 of chamber 150 to first channel 141. Since first channel wall 145 of channel 141 extends substantially in line with second straight wall 159, it can be said that first channel 141 includes a first wall 145 that extends tangentially from the second curved wall 157, and also includes a second wall 146 that is opposite first wall 145 but is not parallel to first wall 145 of first channel 141. Similarly, since first channel wall 145 of channel 142 extends substantially in line with first straight wall 158, it can be said that second channel 142 includes a first wall 145 that extends tangentially from the first curved wall 156, and also includes a second wall 146 that is opposite first wall 145 but is not parallel to first wall 145 of second channel 142. Although first inlet 151 is disposed between first curved wall 156 and second curved wall 157, it is adjacent to first curved wall 156 and second straight wall 159. Similarly, second inlet 152 is adjacent to second curved wall 157 and first straight wall 158.

Figure 9:
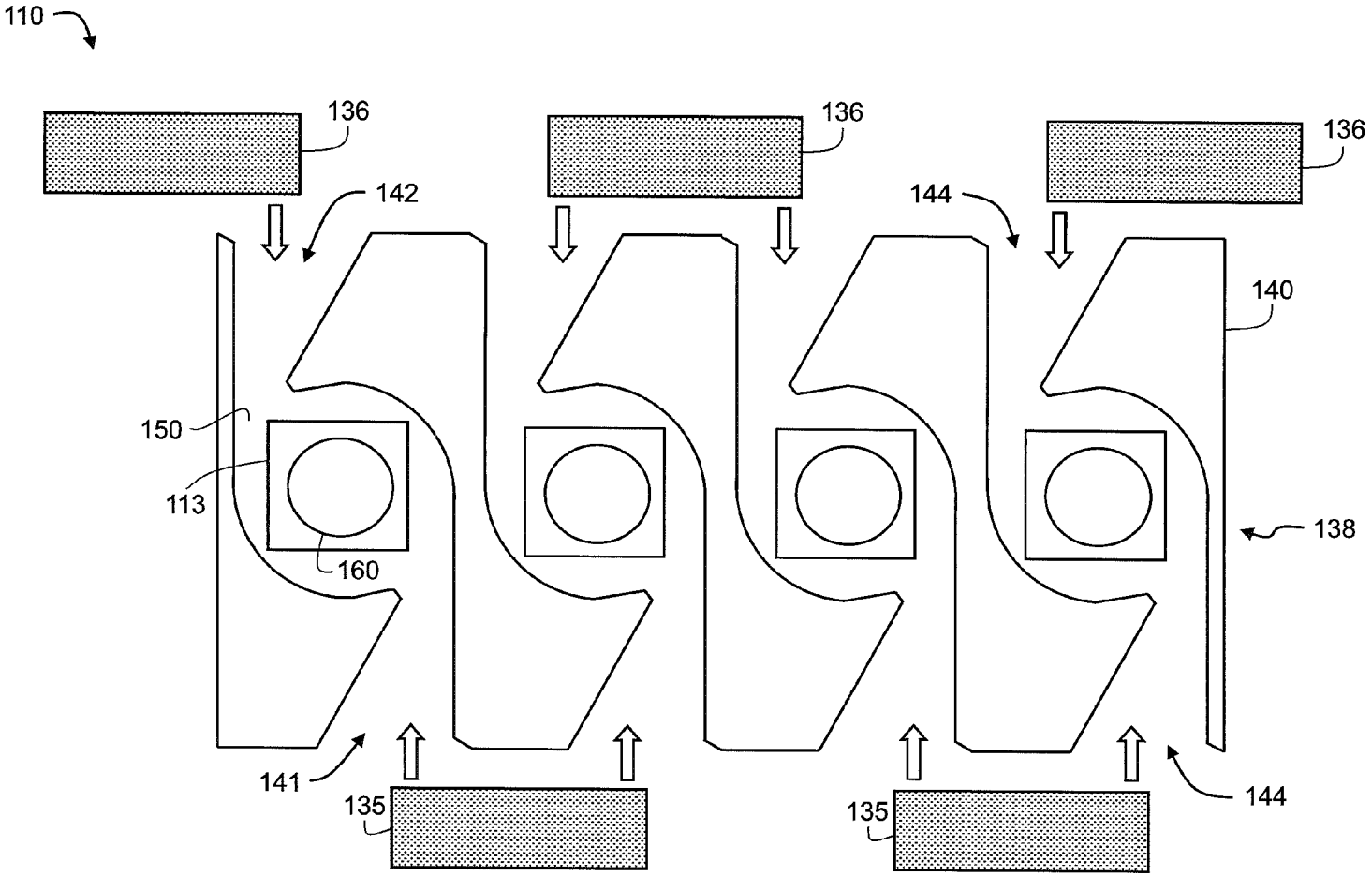
FIG. 9 is a top view of an array of drop generators of the configuration shown in FIG. 8.

Drop generator 138 is a dual feed type structure, characterized by having ink feeds 135 and 136 that provide ink to chamber 150 from opposite sides of the chamber 150. Other dual feed configurations are described in commonly assigned U.S. Pat. No. 7,857,422, which is incorporated by reference herein in its entirety. Ink feeds 135 and 136 are staggered relative to one another and extend beyond drop generator 138 in order to provide ink to adjacent drop generators (not shown). By staggering the ink feeds and providing spaces between ink feeds on a given side of the drop generators, electrical leads (not shown) for heater 113 can be routed to the heater, as is explained in more detail in U.S. Pat. No. 7,857,422. FIG. 9 shows a top view of a portion of an inkjet printhead die 110 having an array of four drop generators 138 of the type shown in FIGS. 7 and 8, together with corresponding ink feeds 135 and 136. Partitioning walls 140 of adjacent chambers 150 are shared. For each of the drop generators 138 in the array, a first ink feed 135 is disposed near the second end 144 of the first channel 141, and a second ink feed 136 is disposed near the second end 144 of the second channel 142. Ink flow from the ink feeds into the channels is indicated by the block arrows. Ink feeds 135 and 136 are each shared between two adjacent drop generators 138. In that way the ink feeds can be spaced sufficiently to allow providing electrical leads (not shown) to heaters 113, while still providing ink flow to each chamber 150 through both the first channel 141 and the second channel 142.

Having described the structure of the preferred embodiment, the context has been provided for describing a method of printing with an inkjet printhead in which a circulating flow of ink around a periphery of the chamber is provided during ink refill. An inkjet printhead, such as printhead 250 shown in FIG. 4 can be provided with one or more ink sources, such as multichamber ink tank 262 and single chamber ink source 264 shown in FIG. 5. The one or more ink sources are fluidically connected to the printhead. Other types of ink sources (such as stationary ink supplies that are not carried along with the printhead 250 on carriage 200) can alternatively be provided to supply ink to printhead 250. Typically, in order to prime the printhead while it is parked over the cap 332 of the maintenance station 330 (FIG. 5), suction is applied to the cap 332 by a pump (not shown), thereby drawing ink through various passageways in the printhead and finally through ink feeds 135 and 136 (FIGS. 7-9) and into the chambers 150 of the drop generators 138, such that the chambers 140 are filled with ink. In order to eject a drop of ink from chamber 150 through nozzle 160, heater 113 is pulsed. When heater 113 is briefly pulsed, it vaporizes a portion of the ink in chamber 150, and the growing vapor bubble pushes a drop of ink out of nozzle 160. Some of the force of the growing bubble pushes ink backward through channels 141 and 142, but the chamber walls and the fluid impedance against flow of ink from the chamber 150 into the channels 141 and 142 due to converging channel walls 145 and 146 are designed to direct a large portion of the force of the growing vapor bubble to eject the drop of ink. The vapor bubble is either vented through the nozzle 160, or it collapses in chamber 150. Capillary action and reduced pressure in the chamber draw ink in to refill chamber 150.

Figure 10:
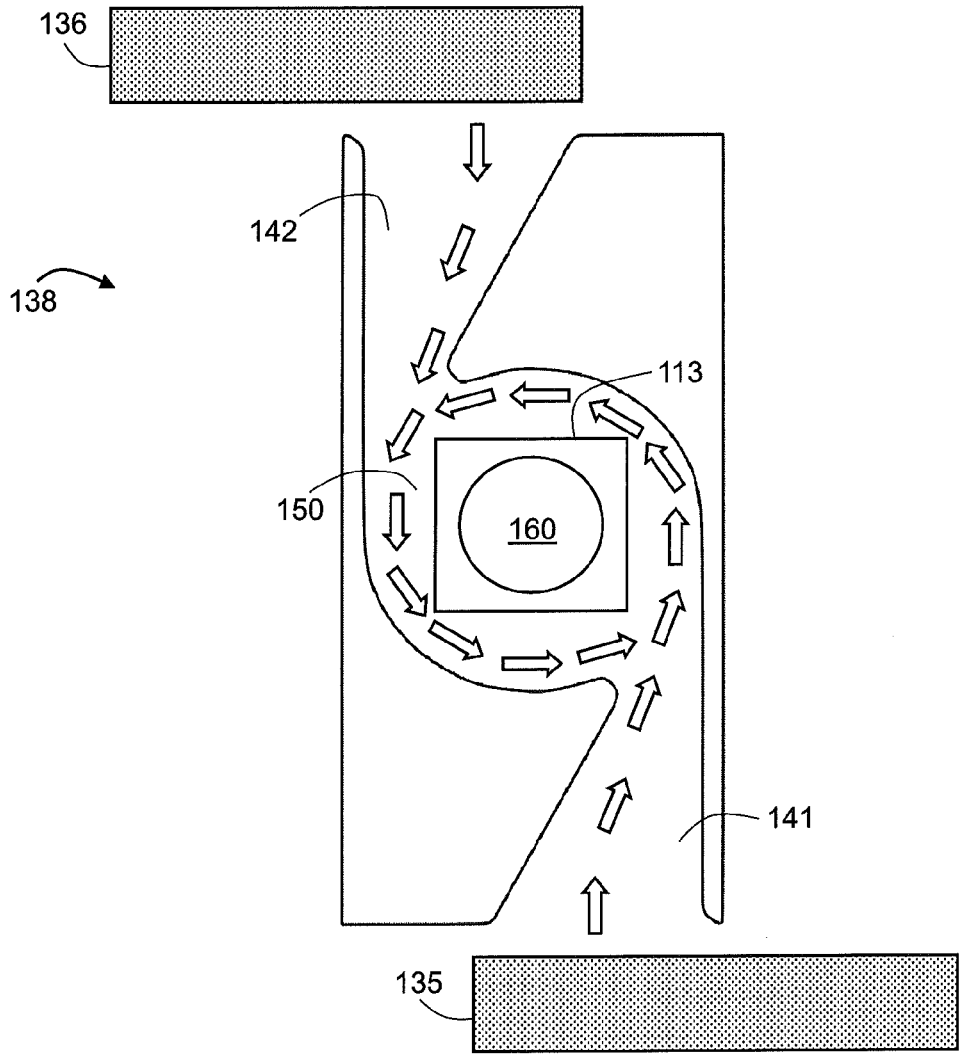
FIG. 10 shows ink flow patterns during refill of the drop generator configuration of FIG. 7.
Figure 11:
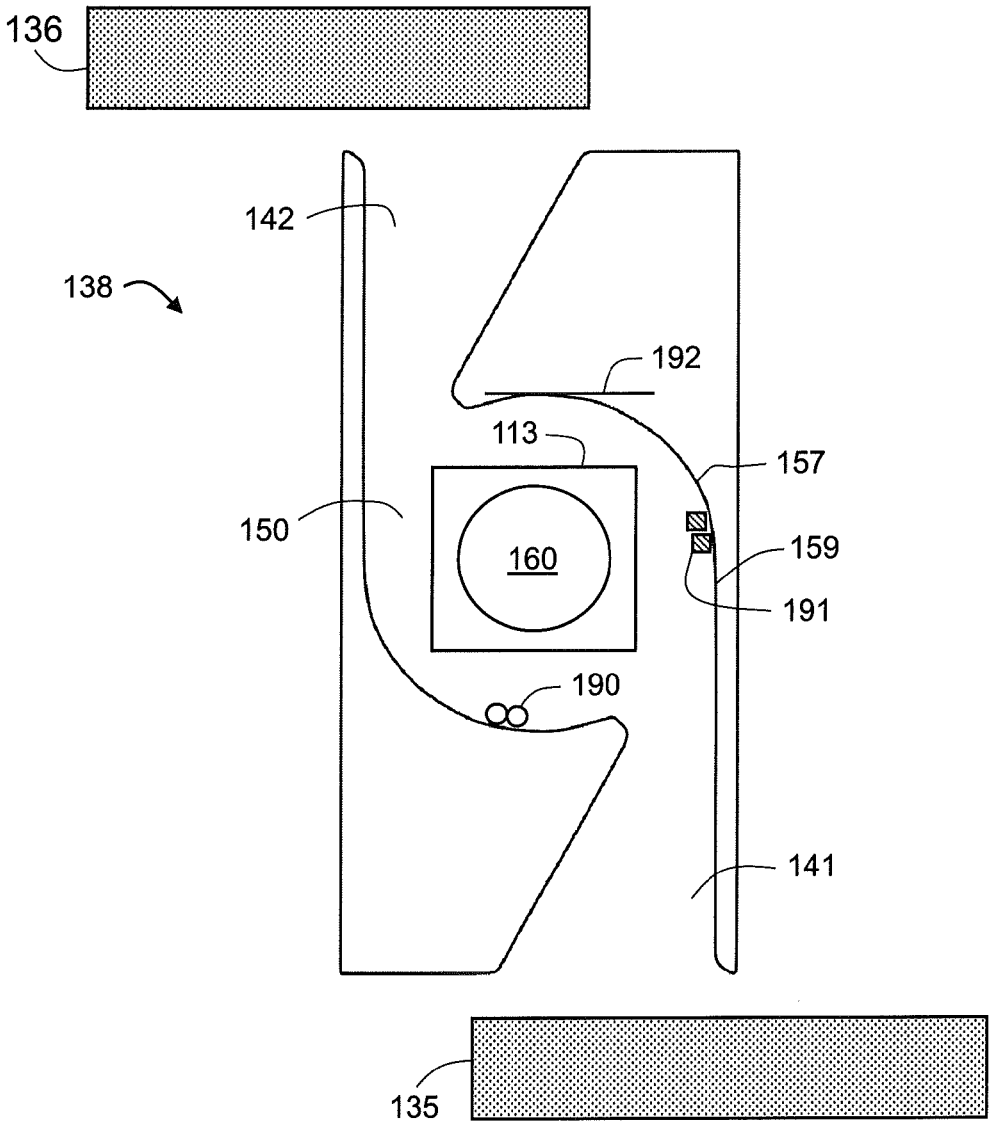
FIG. 11 shows air bubbles and particulates at the wall of the drop generator configuration of FIG. 7.

FIG. 10 illustrates the ink flow patterns during refill of chamber 150. An influx of ink is provided from ink feeds 135 and 136 through channels 141 and 142 respectively into chamber 150, as indicated by the block arrows located in channels 141 and 142. Converging channel walls 145 and 146 (FIG. 8) of channels 141 and 142 direct the flow of ink toward curved walls 157 and 156 respectively. In particular, a first influx of ink is directed by channel 142 along a first direction toward curved wall 156, and a second influx of ink is directed along a second direction that is substantially opposite in direction to the first direction, with the second influx of ink being directed by channel 141 toward curved wall 157 that is opposite curved wall 156. Furthermore, chamber inlet 152 corresponding to the first influx of ink is offset from chamber inlet 151 corresponding to the second influx of ink. The first influx of ink occurs substantially simultaneously with the second influx of ink. As a result of these various factors, a circulating flow of ink is provided around a periphery of the chamber 150, as indicated by the block arrows within chamber 150 in FIG. 10. Although swirling of ink in localized regions can occur during ink refill in conventional drop generator geometries such as the one shown in FIG. 1, the drop generator 138 of FIGS. 7-10 provides a circulating flow of ink around the periphery of the chamber 150, i.e. in a predetermined rotational direction around the chamber. During refilling of chamber 150, the circulating flow of ink is associated with a first fluid velocity near first curved wall 156 that is greater than a second fluid velocity near the center 162 (FIG. 8) of chamber 150. A third fluid velocity near second curved wall 157 is substantially equal to the first fluid velocity. In general the fluid velocity near the chamber walls is higher than the fluid velocity near the center of the chamber 150. Air bubbles 190 and particulates 191 (FIG. 11) that otherwise might tend to stick to the walls of chamber 150 are dislodged by the force of the circulating flow of ink in the chamber. Such dislodged air bubbles 190 and particulates 191 tend to gather in the low fluid velocity region near the center of chamber 150. However, this is where heater 113 and nozzle 160 are located. Thus when the heater 113 is pulsed again to eject a subsequent drop of ink, one or more particulates 191 or air bubbles 190 are ejected through nozzle 160 together with the subsequent drop of ink. FIG. 11 also shows that a tangent 192 to curved wall 157 of chamber 150 is perpendicular to a direction the straight wall 159 of the chamber 150 extends.

In addition to the jetting reliability advantage due to the removal of air bubbles and particulates from chamber 150, a further advantage is provided in some instances due to the circulating flow of ink in the chamber. In particular, the circulating flow can provide angular momentum to the next ejected drop, which can improve its directionality. Since the flow circulates about the nozzle in the plane of the surface 112 of substrate 111 (FIG. 7), the angular momentum vector of the circulating flow is perpendicular to surface 112 and is in the same direction as the desired direction of ejection.

For each drop ejector in an array of drop ejectors 138 as shown in FIG. 9, the ink filling, drop ejection, and refilling associated with an influx of ink as well as a circulating flow around a periphery of the chamber occurs as described above. In some instances the ejecting of a drop from two different chambers occurs at substantially the same time. In such cases, the subsequent refilling of the chambers also happens substantially simultaneously. In other instances, drops of ink from two different chambers occur at different times.

In other embodiments described below (FIG. 12) the chamber can have one or more segmented boundaries 165 formed of segmented straight walls rather than curved walls. The method of refill is still substantially the same for a dual feed geometry with offset inlets. A first influx of ink is directed from ink feed 135 along a first direction toward a first segmented boundary 165 of the chamber 150, and a second influx of ink is directed from ink feed 136 along a second direction that is substantially opposite in direction to the first direction, such that the second influx of ink is directed toward a second segmented boundary 165 that is opposite the first segmented boundary 165 of the chamber 150. Each of the segmented boundaries 165 in the example of FIG. 12 includes a first straight wall 166 that extends substantially in line with a wall of the channel 141 or 142, a second straight wall 167 disposed along a direction that is substantially perpendicular to a direction along which the first straight wall 166 extends, and a third straight wall 168 disposed between the first straight wall 166 and the second straight wall 167, where the third straight wall 168 is neither perpendicular to nor parallel to the direction along with the first straight wall 166 extends. In this example, the walls of channels 141 and 142 are parallel rather than converging. However, both edges 153 and 154 of inlet 151 are on the same side of center 162 as described above for the embodiment shown in FIGS. 7-11, and similarly for inlet 152.

Figure 12:
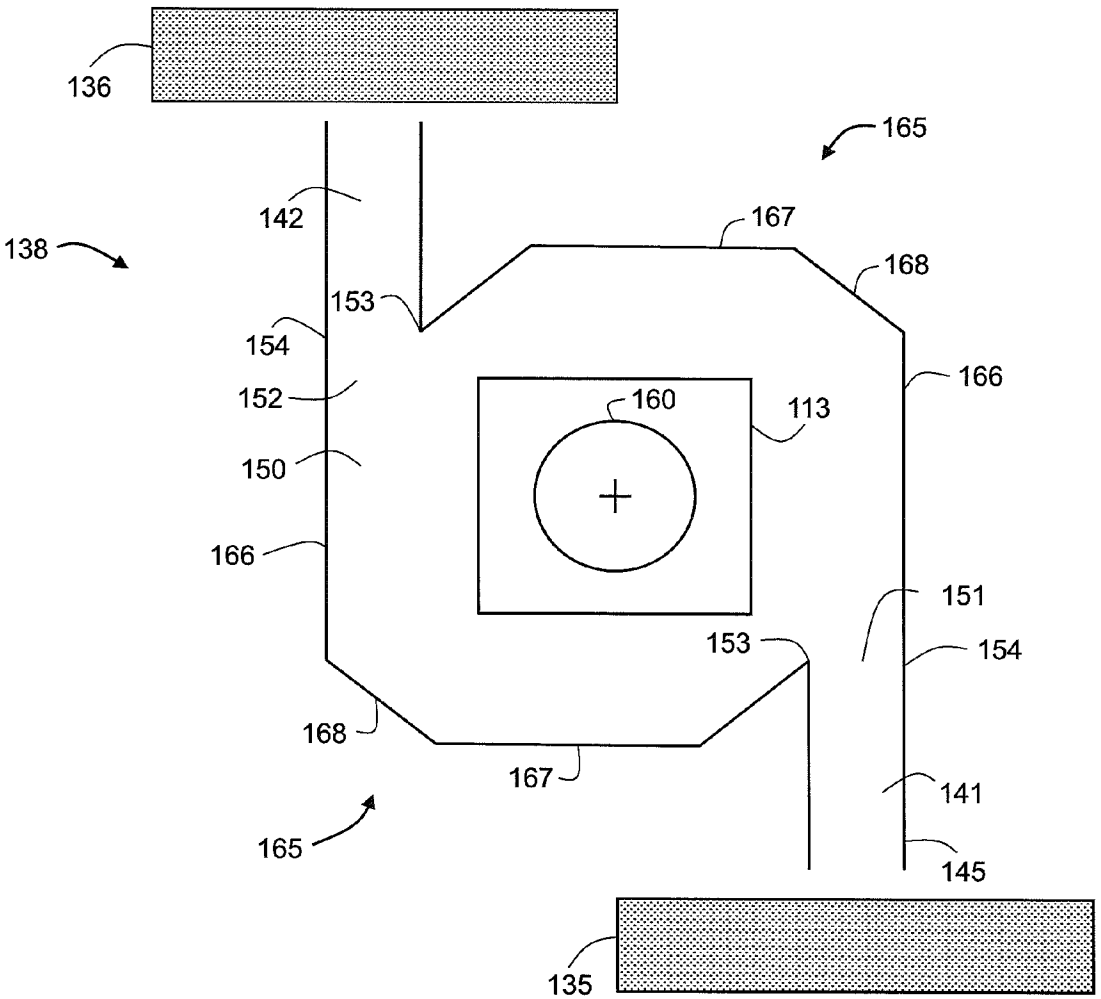
FIG. 12 shows a top view of a drop generator having a chamber with a segmented boundary for providing circulating flow during refill according to an embodiment of the invention.

Whether for the segmented boundary embodiment of FIG. 12 or the curved wall embodiment of FIGS. 7-11, the chamber 150 includes a first chamber wall (e.g. straight wall 166 or 159 respectively) that is disposed substantially in line with a channel wall (e.g. wall 145 of inlet 141). The chamber 150 also includes a wall portion (e.g. straight wall 167 or curved wall portion at tangent 192 respectively) that is disposed along a direction that is substantially perpendicular to the direction of channel wall 145. Further the chamber 150 also includes a second wall portion (e.g. straight wall 168 or a portion of curved wall 157 between tangent 192 and straight wall 159) that is disposed along a direction that is at an angle between ten degrees and eighty degrees with respect to channel wall 145.

A variety of other embodiments exist. Although dual feed configurations have been described above, a single feed embodiment is contemplated in which a single channel is provided offset from the center of the chamber, e.g. where channel 141 is located (FIG. 7), and no channel 142 is provided. The curved walls similar to FIGS. 7-11 or the segmented boundaries similar to FIG. 12 still provide for a circulating flow of ink during refill.

Heater 113 is shown in the embodiments above as having a rectangular outline. The heater itself need not be rectangular however. In some embodiments, where it is desired to have the electrical leads extending from a single side of the heater, the heater can be U-shaped. It can still have a rectangular outline that defines the outside edges of the U.

In order to clarify the terminology used herein, it is useful to consider two other prior art geometries that do not provide a circulating flow of ink around the periphery of the chamber during refill. FIG. 13A shows a drop generator geometry similar to that shown in commonly assigned U.S. Pat. No. 7,600,856. In this configuration a row of posts 36 is disposed outside chamber walls 29 to provide fluid impedance. There is not a separate channel leading from ink feed 35 to chamber 22. Paths between a post 36 and a nearby chamber wall 29 are not an inlet in such a configuration, thereby providing an inlet having two edges that are on the same side of the center of the chamber. It is noted that the present invention is independent of such posts. Rather the inlet 27 in the configuration of FIG. 13A extends across the chamber 22 and has a width W that is symmetric about the center of the chamber. No circulating flow will be provided during refill of the configuration of FIG. 13A since flow paths into the chamber are arranged symmetrically.

Figure 13B:
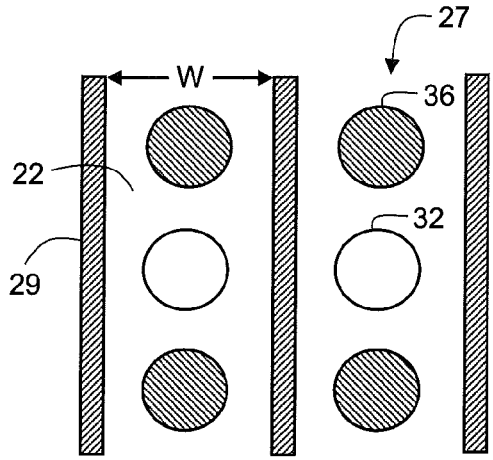
FIG. 13B (PRIOR ART)
FIGS. 13A and 13B show top views of prior art drop generator configurations that do not provide circulating flow during refill.
Figure 13A:
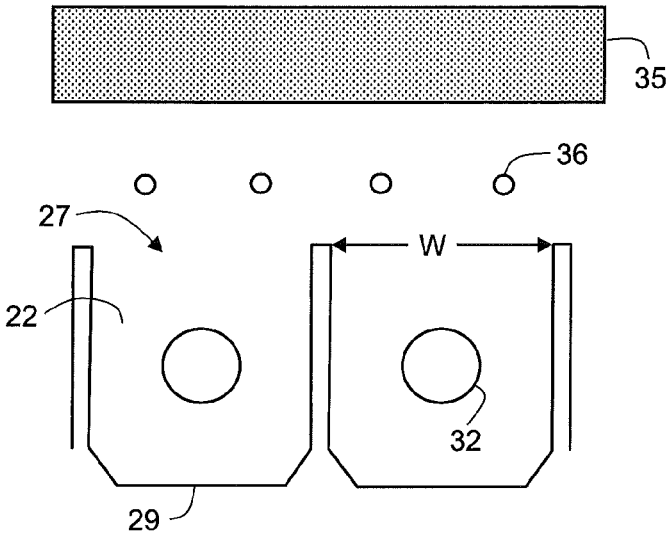
FIG. 13A (PRIOR ART)

FIG. 13B shows a drop generator geometry similar to that shown in U.S. Pat. No. 7,857,422. In this dual-feed configuration posts 36 are disposed on opposite sides of nozzle 32 between chamber walls 29 and provide fluid impedance. Paths between a post 36 and a nearby chamber wall 29 are not an inlet in such a configuration, thereby providing an inlet having two edges that are on the same side of the center of the chamber. It is noted that the present invention is independent of such posts. Rather the inlet 27 in the configuration of FIG. 13B extends across the chamber 22 and has a width W that is symmetric about the center of the chamber. No circulating flow will be provided during refill of the configuration of FIG. 13B since flow paths into the chamber are arranged symmetrically.

The invention has been described in detail with particular reference to certain preferred embodiments thereof, but it will be understood that variations and modifications can be effected within the spirit and scope of the invention. In particular, the invention has been described in the context of a printhead for a carriage printer, but it can also be used in a pagewidth printhead.

PARTS LIST

5 Inkjet printer system
10 Base plate (prior art)
11 Recording medium
12 Image data source
13 Heater
14 Controller
15 Image processing unit
16 Electrical pulse source
18 First fluid source
19 Second fluid source
20 Partition walls (prior art)
21 Chamber center
22 Chamber (prior art)
24 Ink path or channel (prior art)
25 Entry region (of channel)
26 Neck region (of channel)
27 Inlet (of chamber)
27*a* First edge (of inlet)
27*b* Second edge (of inlet)
28 Corner (of chamber)
29 Wall (of chamber)
30 Nozzle plate (prior art)
32 Nozzle (prior art)

35 Ink feed
36 Row of posts
100 Inkjet printhead
110 Inkjet printhead die
111 Substrate
112 Surface (of substrate)
113 Heater
114 Corner
115 Corner
116 Corner
117 Corner
120 First nozzle array
121 Nozzle(s)
122 Ink delivery pathway (for first nozzle array)
130 Second nozzle array
131 Nozzle(s)
132 Ink delivery pathway (for second nozzle array)
135 Ink feed
136 Ink feed
138 Drop generator
140 Partitioning wall
141 Channel
142 Channel
143 First end (of channel)
144 Second end (of channel)
145 Wall (of channel)
146 Wall (of channel)
150 Chamber
151 Inlet
152 Inlet
153 Edge (of inlet)
154 Edge (of inlet)
155 Inlet width direction
156 Curved wall (of chamber)
157 Curved wall (of chamber)
158 Straight wall (of chamber)
159 Straight wall (of chamber)
160 Nozzle
162 Center (of chamber)
165 Segmented boundary
166 First straight wall
167 Second straight wall
168 Third straight wall
181 Droplet(s) (ejected from first nozzle array)
182 Droplet(s) (ejected from second nozzle array)
190 Air bubble(s)
191 Particulate(s)
192 Tangent
200 Carriage
250 Printhead
251 Printhead die
253 Nozzle array
254 Nozzle array direction
256 Encapsulant
257 Flex circuit
258 Connector board
262 Multi-chamber ink supply
264 Single-chamber ink supply
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
332 Cap
370 Stack of media
371 Top piece of medium
380 Carriage motor
382 Carriage guide rail
383 Encoder fence
384 Belt
390 Printer electronics board
392 Cable connectors

The invention claimed is:

1. An inkjet printhead comprising:
a substrate including a surface;
a first chamber disposed on the surface of the substrate, the first chamber including:
a first curved wall;
a second curved wall opposite the first curved wall;
a first inlet disposed between the first curved wall and the second curved wall; and
a second inlet disposed between the first curved wall and the second curved wall, the second inlet being on an opposite side of the chamber from the first curved wall;
a second chamber disposed on the surface of the substrate, the second chamber including:
a third curved wall;
a fourth curved wall opposite the third curved wall;
a third inlet disposed between the third curved wall and the fourth curved wall; and
a fourth inlet disposed between the third curved wall and the fourth curved wall, the fourth inlet being on an opposite side of the chamber from the third inlet;
a partitioning wall disposed between the first and second chambers, and the partitioning wall includes the second curved wall of the first chamber and the third curved wall of the second chamber.

2. The inkjet printhead of claim 1, further comprising:
a first channel including a first end disposed adjacent the first inlet and a second end opposite the first end of the first channel; and
a second channel including a first end disposed adjacent the second inlet and a second end opposite the first end of the second channel, wherein for each of the first and second channels, a width of the second end is greater than a width of the first end.

3. The inkjet printhead of claim 2, the first chamber further comprising:
a first straight wall that extends tangentially from the first curved wall of the first chamber to the second channel; and
a second straight wall that extends tangentially from the second curved wall of the first chamber to the first channel.

4. The inkjet printhead of claim 2, wherein the first channel includes a first wall that extends tangentially from the second curved wall of the first chamber and a second wall that is opposite to the first wall of the first channel but not parallel to the first wall of the first channel; and wherein the second channel includes a first wall that extends tangentially from the first curved wall of the first chamber and a second wall that is opposite to the first wall of the second channel but not parallel to the first wall of the second channel.

5. The inkjet printhead of claim 2 further comprising:

a first ink feed disposed through the substrate and proximate the second end of the first channel; and a second ink feed through the substrate and proximate the second end of the second channel.

6. The inkjet printhead of claim 1, further comprising a drop forming element disposed on the surface of the substrate within the first chamber.

7. The inkjet printhead of claim 6, wherein the drop forming element is a heater.

8. The inkjet printhead of claim 7, wherein the heater includes a rectangular outline having a first corner, a second corner, a third corner diagonally opposite the first corner and a fourth corner diagonally opposite the second corner, wherein the first corner is disposed adjacent the first inlet and the third corner is disposed adjacent the second inlet.

9. The inkjet printhead of claim 8, wherein the second corner is disposed adjacent the second curved wall and the fourth corner is disposed adjacent the first curved wall.

10. The inkjet printhead of claim 7, the heater including a center and the nozzle including a center, wherein the center of the nozzle is in line with the center of the heater.

11. An inkjet printer comprising:

a media advance system;

an inkjet printhead comprising:

a substrate including a surface;

a first chamber disposed on the surface of the substrate, the first chamber including:

a first curved wall;

a second curved wall opposite the first curved wall;

a first inlet disposed between the first curved wall and the second curved wall; and a second inlet disposed between the first curved wall and the second curved wall, the second inlet being on an opposite side of the chamber from the first curved wall;

a second chamber disposed on the surface of the substrate, the second chamber including:

a third curved wall;

a fourth curved wall opposite the third curved wall;

a third inlet disposed between the third curved wall and the fourth curved wall; and a fourth inlet disposed between the third curved wall and the fourth curved wall, the fourth inlet being on an opposite side of the chamber from the third inlet;

a partitioning wall disposed between the first and second chambers, and the partitioning wall includes the second curved wall of the first chamber and the third curved wall of the second chamber.

* * * * *